US007445685B2

(12) United States Patent
Deakin et al.

(10) Patent No.: US 7,445,685 B2
(45) Date of Patent: Nov. 4, 2008

(54) ARTICLE HAVING A VIBRATION DAMPING COATING AND A METHOD OF APPLYING A VIBRATION DAMPING COATING TO AN ARTICLE

(75) Inventors: Martin J Deakin, Ashby-de-la-zouch (GB); John T Gent, Derby (GB); Mark H Shipton, deceased, late of Bristol (GB); by Joanne M Shipton, legal representative, Bristol (GB)

(73) Assignee: Rolls-Royce PLC, London (GB)

( * ) Notice: Subject to any disclaimer, the term of this patent is extended or adjusted under 35 U.S.C. 154(b) by 317 days.

(21) Appl. No.: 11/067,738

(22) Filed: Mar. 1, 2005

(65) Prior Publication Data

US 2005/0214505 A1 Sep. 29, 2005

(30) Foreign Application Priority Data

Mar. 23, 2004 (GB) ..... 0406444.0

(51) Int. Cl.
*B32B 37/12* (2006.01)
*B32B 37/14* (2006.01)
*F01D 5/26* (2006.01)

(52) U.S. Cl. ..... 156/212; 156/278; 156/279; 416/241 B; 416/500

(58) Field of Classification Search ..... 156/212, 156/278, 280; 416/241 B
See application file for complete search history.

(56) References Cited

U.S. PATENT DOCUMENTS

| | | | | |
|---|---|---|---|---|
| 2,355,568 | A * | 8/1944 | Smith | 428/47 |
| 3,301,530 | A | 1/1967 | Lull | |
| 3,386,527 | A * | 6/1968 | Daubert et al. | 181/208 |
| 3,962,486 | A * | 6/1976 | Gerek et al. | 427/447 |
| 4,223,073 | A * | 9/1980 | Caldwell et al. | 428/422 |
| 4,447,493 | A * | 5/1984 | Driscoll et al. | 428/332 |
| 5,295,789 | A | 3/1994 | Daguet | |
| 5,438,806 | A * | 8/1995 | Reinhall | 52/167.1 |
| 5,498,137 | A | 3/1996 | El-Aini et al. | |
| 5,691,037 | A * | 11/1997 | McCutcheon et al. | 428/172 |
| 5,913,661 | A | 6/1999 | Panovsky et al. | |
| 6,039,542 | A * | 3/2000 | Schilling et al. | 416/233 |
| 6,059,533 | A * | 5/2000 | Stoker et al. | 416/241 B |
| 6,213,721 | B1 * | 4/2001 | Watkinson | 416/244 A |
| 6,251,493 | B1 * | 6/2001 | Johnson et al. | 428/71 |
| 6,471,484 | B1 * | 10/2002 | Crall | 416/229 R |
| 6,648,593 | B2 * | 11/2003 | Motherwell et al. | 415/119 |
| 6,887,528 | B2 * | 5/2005 | Lau et al. | 427/448 |

(Continued)

FOREIGN PATENT DOCUMENTS

EP 0 924 380 A2 6/1999

(Continued)

*Primary Examiner*—Melvin C Mayes
(74) *Attorney, Agent, or Firm*—Oliff & Berridge, PLC

(57) ABSTRACT

A compressor blade (30) comprises a vibration damping coating (54) on a first surface of at least one portion of an erosion resistant material (56). The vibration damping coating (54) comprises a plurality of segments (58). The portion of erosion resistant material (56) and the vibration damping coating (54) are adhesively bonded to the compressor blade (30) such that the vibration damping coating (54) is arranged between the surface (50) of the compressor blade (30) and the portion of erosion resistant material (56).

17 Claims, 3 Drawing Sheets

U.S. PATENT DOCUMENTS

| | | | | |
|---|---|---|---|---|
| 7,198,858 | B2 * | 4/2007 | Shipton et al. | 428/632 |
| 2002/0090302 | A1 | 7/2002 | Norris et al. | |
| 2002/0122718 | A1 * | 9/2002 | Motherwell et al. | 415/119 |
| 2003/0217791 | A1 * | 11/2003 | Bamberg et al. | 148/525 |
| 2005/0013994 | A1 * | 1/2005 | Strangman | 428/336 |
| 2005/0260425 | A1 * | 11/2005 | Shipton et al. | 428/472 |
| 2006/0078432 | A1 * | 4/2006 | Darolia et al. | 416/241 R |

FOREIGN PATENT DOCUMENTS

| | | | |
|---|---|---|---|
| EP | 1 026 366 | A1 | 8/2000 |
| GB | 2 397 257 | | 7/2004 |
| GB | 2 407 523 | * | 5/2005 |

* cited by examiner

ARTICLE HAVING A VIBRATION DAMPING COATING AND A METHOD OF APPLYING A VIBRATION DAMPING COATING TO AN ARTICLE

The present invention relates to an article having a vibration damping coating and a method of applying a vibration damping coating to an article. In particular the present invention relates to a vibration damping coating for a fan blade, a compressor blade, a compressor vane, a turbine blade or a turbine vane of a gas turbine engine.

Gas turbine engine components, for example blades or vanes, may suffer from modes of vibration in operation, which result in a deterioration of the mechanical properties of the gas turbine engine component. Strengthening of the blades or vanes to combat these modes of vibration may require a major redesign of the blades or vanes.

It is known to provide a vibration damping coating on gas turbine engine blades or vanes to damp these modes of vibrations of the blades or vanes when the gas turbine engine is in use. Typically such vibration damping coatings comprise ceramic materials and they are applied by plasma, or thermal, spraying as described in published UK patent application GB2346415A, UK patent GB1369558 and U.S. Pat. No. 6,059,533.

A problem for some articles, for example a disc with integral blades also known as a blisk, is that it is difficult to apply these ceramic coatings because plasma, or thermal, spraying is a line of sight process and therefore access to some regions of the blades is difficult or prevented.

A further problem with ceramic coatings applied by plasma, or thermal, spraying is that they are susceptible to erosion damage.

Accordingly the present invention seeks to provide a novel vibration damping coating on an article and a novel method of applying a vibration damping coating to an article.

Accordingly the present invention provides a method of applying a vibration damping coating to an article comprising the steps of:

(a) depositing a vibration damping coating on a first surface of a portion of an erosion resistant material, the vibration damping coating comprises a plurality of segments, (b) adhesively bonding the portion of erosion resistant material and the vibration damping coating to the article such that the vibration damping coating is between the surface of the article and the portion of erosion resistant material.

Preferably step (a) comprises depositing a vibration damping material onto a first surface of a plurality of portions of an erosion resistant material, the vibration damping coating on each portion of erosion resistant material comprises a plurality of segments and step (b) comprises adhesively bonding the portions of erosion resistant material and the vibration damping coating to the article such that the vibration damping coating is between the surface of the article and the portions of erosion resistant material and such that the portions of erosion resistant material are arranged on different regions of the surface of the article.

Preferably step (a) comprises depositing the vibration damping coating by plasma spraying.

Preferably step (a) comprises placing a mesh on the erosion resistant material, subsequently depositing the vibration damping coating and removing the mesh to form the plurality of segments.

Alternatively step (a) comprises treating the vibration damping coating during or after deposition of the vibration damping coating to cause the vibration damping coating to form a plurality of segments.

Preferably in step (a) the portion of erosion resistant material is flat during the deposition of the vibration damping coating and in step (b) the portion of erosion resistant material is moulded to the shape of the article during the bonding of the portion of the erosion resistant material and the vibration damping coating to the surface of the article.

Preferably after step (a) and before step (b) the vibration damping coating is impregnated with a polymer material.

Preferably the vibration damping coating comprises a ceramic. Preferably the vibration damping coating comprises magnesium aluminate, calcium silicate, zirconia or yttria stabilised zirconia.

Preferably the erosion resistant material comprises a metal. Preferably the erosion resistant material comprises stainless steel, a nickel alloy or a cobalt alloy.

Preferably the adhesive comprises a structural adhesive.

The portion of erosion resistant material and vibration damping coating may be heat treated after step (a) and before step (b). An erosion resistant coating may be applied to a second surface of the portion of erosion resistant material either before or after step (a). The erosion resistant coating may be applied by plasma spraying.

Preferably the article comprises a component of a gas turbine engine. Preferably the article comprises a fan blade, a compressor blade, a compressor vane, a turbine blade or a turbine vane. Preferably the article comprises a rotor with integral blades. The blades may be diffusion bonded onto, friction welded onto or machined out of the rotor.

The present invention also provides an article comprising a vibration damping coating on a first surface of at least one portion of an erosion resistant material, the vibration damping coating comprising a plurality of segments, the portion of erosion resistant material and the vibration damping coating being adhesively bonded to the article such that the vibration damping coating being arranged between the surface of the article and the portion of erosion resistant material.

Preferably the article comprises a vibration damping material on a first surface of a plurality of portions of an erosion resistant material, the vibration damping coating on each portion of erosion resistant material comprising a plurality of segments, the portions of erosion resistant material and the vibration damping coating being adhesively bonded to the article such that the vibration damping coating being arranged between the surface of the article and the portions of erosion resistant material and such that the portions of erosion resistant material being arranged on different regions of the surface of the article.

Preferably the vibration damping coating is impregnated with a polymer material.

Preferably the vibration damping coating comprises a ceramic. Preferably the vibration damping coating comprises magnesium aluminate, calcium silicate, zirconia or yttria stabilised zirconia.

Preferably the erosion resistant material comprises a metal. Preferably the erosion resistant material comprises stainless steel, a nickel alloy or a cobalt alloy.

Preferably the adhesive comprises a structural adhesive.

An erosion resistant coating may be arranged on a second surface of the portion of erosion resistant material.

Preferably the article comprises a component of a gas turbine engine. Preferably the article comprises a fan blade, a compressor blade, a compressor vane, a turbine blade or a turbine vane. Preferably the article comprises a rotor with integral blades. The blades may be diffusion bonded onto, friction welded onto or machined out of the rotor.

The present invention will be more fully described by way of example with reference to the accompanying drawings in which:—

Figure 1:
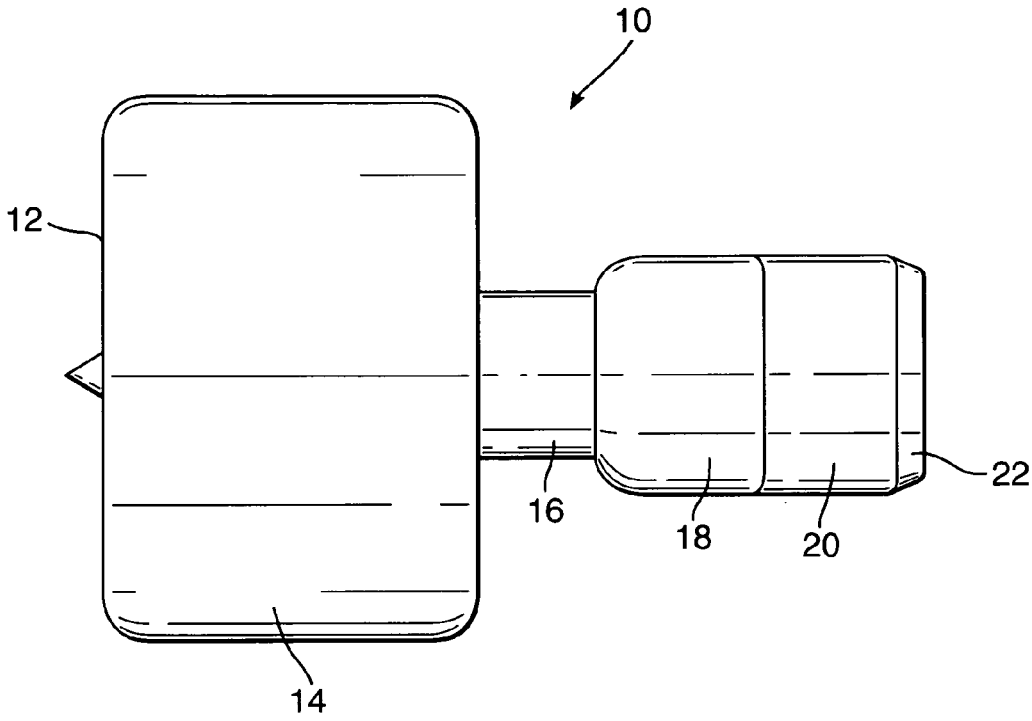
FIG. 1 shows a turbofan gas turbine engine having a blade having a vibration damping coating according to the present invention.

A turbofan gas turbine engine 10, as shown in FIG. 1, comprises in flow series an intake 12, a fan section 14, a compressor section 16, a combustion section 18, a turbine section 20 and an exhaust section 22. The turbine section 20 comprises one or more turbines (not shown) arranged to drive a fan (not shown) in the fan section 14 via a shaft (not shown) and one or more turbines (not shown) arranged to drive one or more compressors (not shown) in the compressor section 16 via one or more shafts (not shown).

The fan, compressors and turbines comprise blades mounted on a fan rotor, a compressor rotor or a turbine rotor respectively.

Figure 2:
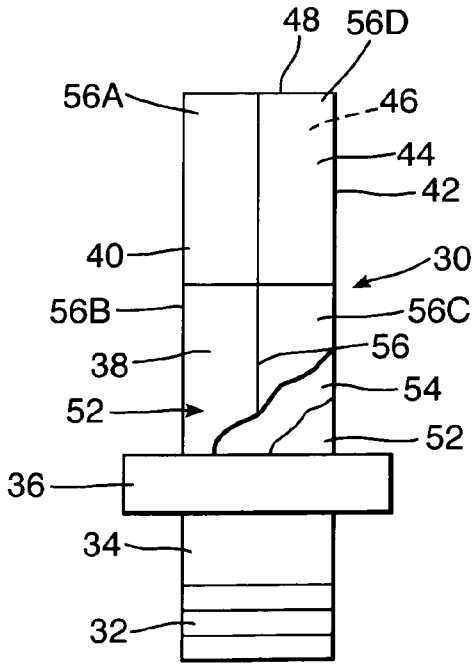
FIG. 2 shows an enlarged view of a blade having a vibration damping coating according to the present invention.

A compressor blade 30, as shown in FIG. 2, comprises a root portion 32, a shank portion 34, a platform portion 36 and an aerofoil portion 38. The aerofoil portion 38 comprises a leading edge 40, a trailing edge 42, a concave pressure surface 44 which extends form the leading edge 38 to the trailing edge 40 and a convex suction surface 46 which extends from the leading edge 38 to the trailing edge 40 and a radially outer tip 48. The aerofoil portion 38 is provided with a vibration damping coating 52 according to the present invention. The vibration damping coating 52, as shown more clearly in FIG. 4, comprises a vibration damping coating 54 and a portion of an erosion resistant material 56. The vibration damping coating 54 is arranged on a first surface of a portion of the erosion resistant material 56. The vibration damping coating 54 comprises a plurality of segments 58 separated by gaps 59. In this embodiment the segments 58 are hexagonal, but other suitable shapes may be used. The portion of erosion resistant material 56 and the vibration damping coating 54 are adhesively bonded to the aerofoil portion 38 of the compressor blade 30 such that the vibration damping coating 54 is arranged between the surface 50 of the aerofoil portion 38 of the compressor blade 30 and the portion of erosion resistant material 56.

Figure 3:
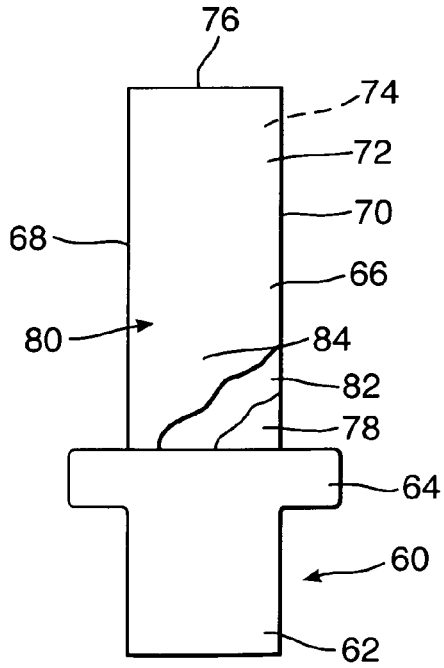
FIG. 3 shows an enlarged view of a portion of rotor with integral blades having a vibration damping coating according to the present invention.

A compressor rotor 60 with integral blades, as shown in FIG. 3, comprises a rotor disc 62, a rim 64, and a plurality of aerofoil portions 66. Each aerofoil portion 66 comprises a leading edge 68, a trailing edge 70, a concave pressure surface 72 which extends form the leading edge 68 to the trailing edge 70 and a convex suction surface 74 which extends from the leading edge 68 to the trailing edge 70 and a radially outer tip 76. The aerofoil portions 66 are diffusion bonded onto, friction welded onto or machined out of the rotor 60.

The aerofoil portions 66 are provided with a vibration damping coating 80 according to the present invention. The vibration damping coating 80, is similar to that shown in FIG. 4, and comprises a vibration damping coating 82 and a portion of an erosion resistant material 84. The vibration damping coating 80 is arranged on a first surface of a portion of the erosion resistant material 82. The vibration damping coating 80 comprises a plurality of segments separated by gaps. In this embodiment the segments are hexagonal, but other suitable shapes may be used. The portion of erosion resistant material 82 and the vibration damping coating 80 are adhesively bonded to the aerofoil portions 68 of the compressor rotor 60 with integral blades such that the vibration damping coating 80 is arranged between the surface 78 of the aerofoil portions 68 of the compressor rotor 60 and the portion of erosion resistant material 84.

The aerofoil portion 38 of the compressor blade 30 comprises a vibration damping material on a first surface of a plurality of portions 56A, 56B, 56C and 56D of an erosion resistant material 56. The vibration damping coating 54 on each portion of erosion resistant material 56A, 56B, 56C and 56D comprises a plurality of segments 58. The portions of erosion resistant material 56A, 56B, 56C and 56D and the vibration damping coating 54 are adhesively bonded to the aerofoil portion 38 of the compressor blade 30 such that the vibration damping coating 54 is arranged between the surface 50 of the aerofoil portion 38 of the compressor blade 30 and the portions of erosion resistant material 56A, 56B, 56C and 56D and such that the portions of erosion resistant material 56A, 56B, 56C and 56D are arranged on different regions of the surface 50 of the aerofoil portion 38 of the compressor blade 30. The portions 56A, 56B, 56C and 56D of erosion resistant material 56 thus form a plurality of tiles on the surface 50 of the aerofoil portion 38 of the compressor blade 30.

The vibration damping coating 54 comprises a ceramic and preferably the vibration damping coating 54 comprises magnesium aluminate (magnesia alumina) spinel, e.g. $MgO.Al_2O_3$, calcium silicate, zirconia, e.g. $ZrO_2$, or yttria stabilised zirconia, e.g. $ZrO_2$ 8 wt % $Y_2O_3$.

The vibration damping coating 54 is preferably impregnated with a polymer material to further increase the vibration damping properties of the vibration damping coating.

The erosion resistant material preferably comprises a metal, for example stainless steel, a nickel base alloy or a cobalt base alloy. The erosion resistant material may comprise a metal foil.

The adhesive comprises a structural adhesive, for example Henkel Loctite Hysol (RTM) EA9395, supplied by Henkel Loctite, but other suitable structural adhesives may be used.

Figure 5:
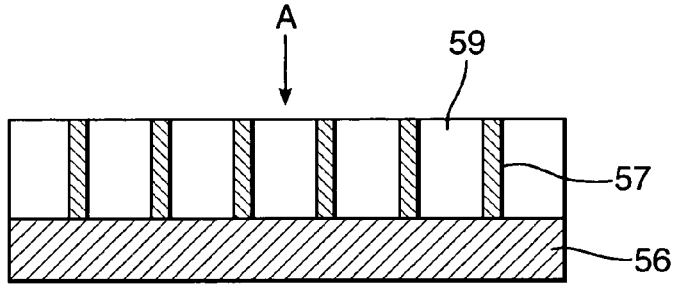
FIGS. 5 to 9 are diagrammatic representation of steps in the method of applying a vibration damping coating according to the present invention.
Figure 6:
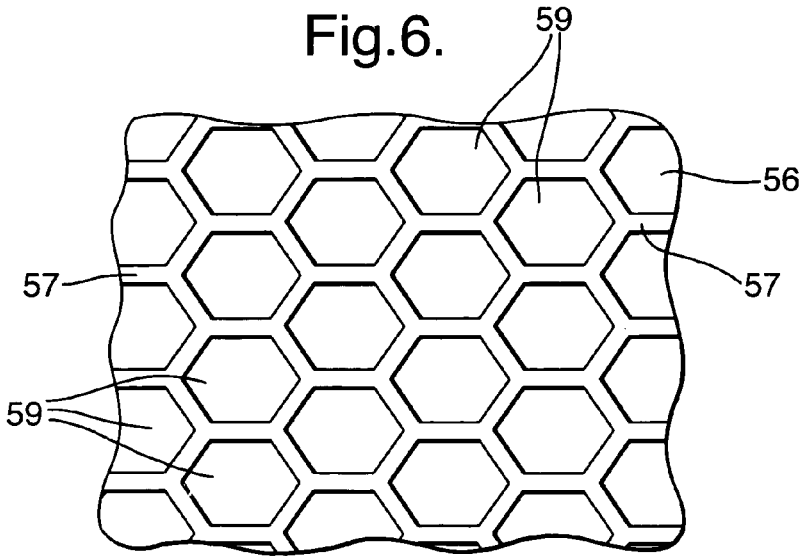

FIG. 5 to 9 illustrate how the vibration damping coating 52 is applied to the aerofoil portion 38 of the compressor blade 30. Firstly, as shown in FIGS. 5 and 6, a portion, or piece, of an erosion resistant material 56 is cut to required the required dimensions and if more than one portion 56A, 56B, 56C and 56D of erosion resistant material 56 is used they are all cut to required dimensions to match and abut against adjacent portions 56A, 56B, 56C and 56D of erosion resistant material 56. Then a mesh, or mask, 57 is arranged on the surface of the portion of erosion resistant material 56 and the mesh, or mask, 57 defines cells 59, as shown in FIG. 6. In this example the mesh, or mask, 57 is hexagonal to define honeycomb cells 59, but other suitable shapes of mesh, mask, 57 may be used. The mesh 57 for example comprises a metal.

Figure 7:
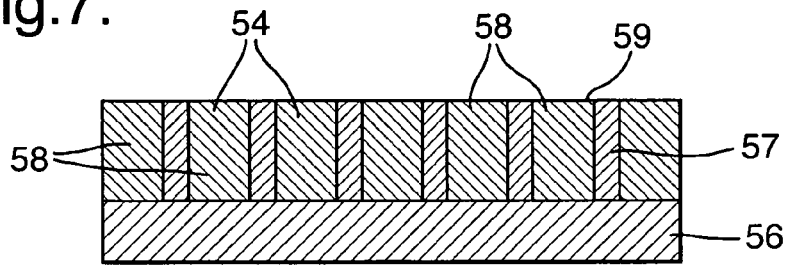

Then a vibration damping coating 54 is plasma sprayed, high velocity oxy fuel sprayed (HVOF) through the mesh, mask, 57 onto the portion of erosion resistant material 56 to form a plurality of segments 58 of vibration damping coating 54 on the portion of erosion resistant material 56 which are separated by the mesh 57, as shown in FIG. 7.

Figure 8:
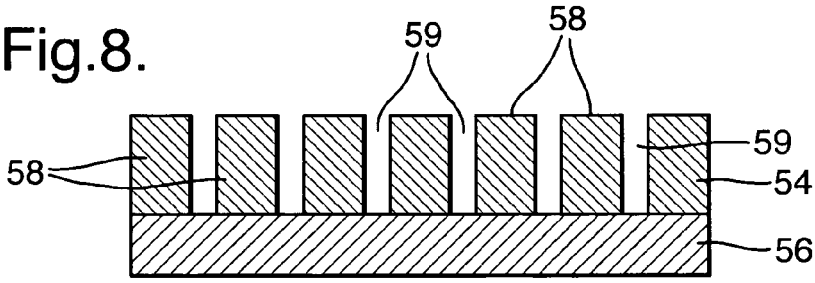

The mesh 57 is then removed, for example by acid etching, to leave a plurality of segments 58 of vibration damping coating 54 on the portion of erosion resistant material 56, which are separated by gaps 59, as shown in FIG. 8.

Figure 9:
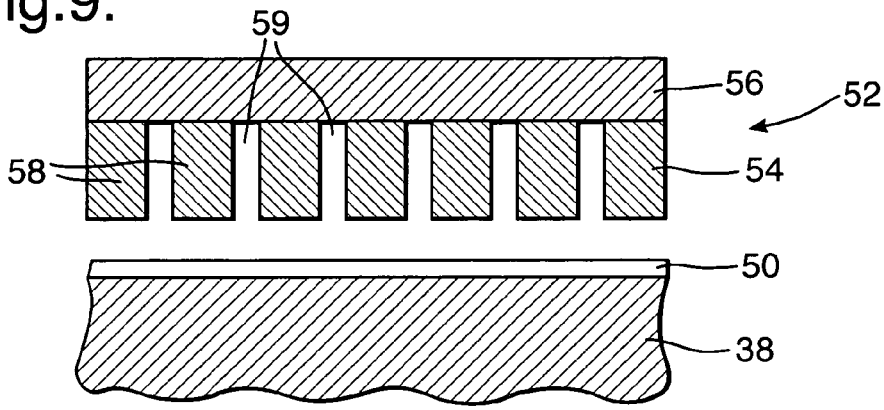

The portion of erosion resistant material 56 and the vibration damping coating 54 comprising a plurality of discrete separated segments 58 is then adhesively bonded onto the surface 50 of the aerofoil portion 38 of the compressor blade 30 such that the vibration damping coating 54 is arranged between the aerofoil portion 38 of the compressor blade 30 and the erosion resistant material, as shown in FIG. 9.

The portion of erosion resistant material 56 in this example comprises a flat foil and thus is flat during the deposition of the vibration damping coating 54. The portion of erosion resistant material 56 is moulded to the shape of the aerofoil portion 38 of the compressor blade 30 during the adhesive bonding of the portion of the erosion resistant material 56 and the vibration damping coating 54 to the surface 50 of the aerofoil portion 38 of the compressor blade 30.

The advantage of the present invention is that the vibration damping coating is segmented and this improves the resistance of the vibration damping coating to erosion. Furthermore, the erosion resistant material improves the erosion resistance of the vibration damping coating. In addition the segmentation of the vibration damping coating provides compliance to enable the vibration damping coating to be formed to the shape of the article and adhesively bonded to the article.

As a further alternative the portion of erosion resistant material may be preformed to the required shape by an electroforming method before the vibration damping coating is applied.

The segments 58 in the vibration damping coating 54 may be produced during or after deposition of the vibration damping coating 54 due to thermal stresses produced in the vibration damping coating 54 due to the deposition parameters.

The manufacturing process also allows other process steps to be included prior to the adhesive bonding of the vibration damping coating to the article. This has the advantage that processes, which are difficult or impossible to perform in situ on the article become possible.

Figure 4:
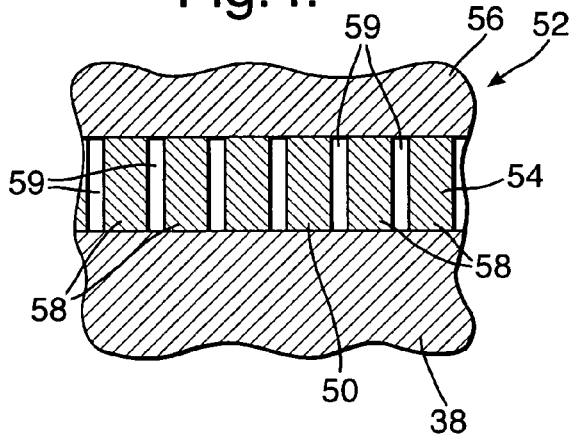
FIG. 4 is a further enlarged cross-sectional view through the vibration damping coating shown in FIG. 2.
Figure 10:
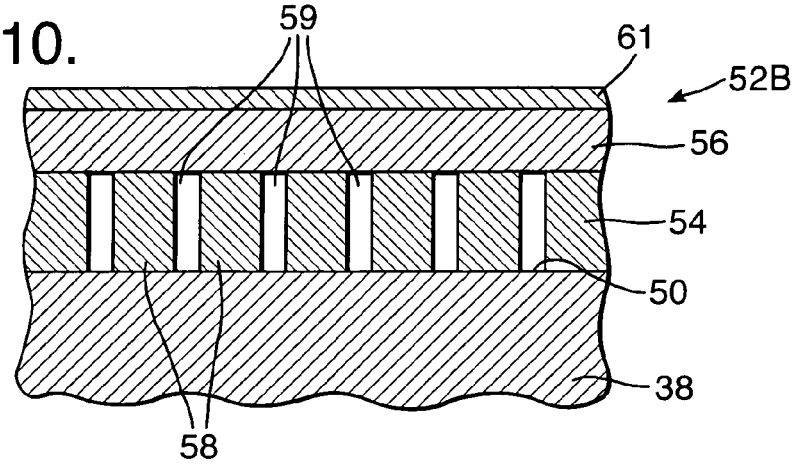
FIG. 10 is a further enlarged cross-sectional view through an alternative vibration damping coating shown in FIG. 2.

The embodiment in FIG. 10 is substantially the same as that shown in FIG. 4, like parts are denoted by like numerals. However, an erosion resistant coating 61 is arranged on a second, outer, surface of the portion of erosion resistant material 56. The erosion resistant coating may comprise a composite carbide for example tungsten carbide and cobalt applied by plasma spraying or HVOF. The erosion resistant coating may be deposited by electroplating, physical vapour deposition or chemical vapour deposition. The erosion resistant coating deposited by physical vapour deposition may be a multi-layer coating comprising alternate layers of metal and ceramic for example tungsten and titanium diboride.

Also heat treatments may be performed before the vibration damping coating is adhesively bonded to the article.

The vibration damping coating 54 may be impregnated with a polymer material after the vibration damping coating has been deposited onto the portion of erosion resistant material 56. The polymer material further increases the vibration damping properties of the vibration damping coating.

Although the present invention has been described with reference to applying a vibration damping coating to a compressor blade or integrally bladed compressor rotor, it may be equally applicable to fan blades, compressor vanes, turbine blades, turbine vanes, other gas turbine engine components or other articles where vibration damping is required.

We claim:

1. A method of applying a vibration damping coating to an article comprising:

(a) depositing a ceramic vibration damping coating on a first surface of a portion of an erosion resistant material by plasma-spraying a ceramic, the ceramic vibration damping coating comprising a plurality of segments, and (b) adhesively bonding the portion of erosion resistant material and the ceramic vibration damping coating to a surface of the article such that the ceramic vibration damping coating is between the surface of the article and the portion of erosion resistant material;

wherein the plurality of segments of the ceramic vibration damping coating are separated by gaps.

2. A method as claimed in claim 1 wherein step (a) comprises depositing a vibration damping material onto a first surface of a plurality of portions of an erosion resistant material, the vibration damping coating on each portion of erosion resistant material comprises a plurality of segments and step (b) comprises adhesively bonding the portions of erosion resistant material and the vibration damping coating to the article such that the vibration damping coating is between the surface of the article and the portions of erosion resistant material and such that the portions of erosion resistant material are arranged on different regions of the surface of the article.

3. A method as claimed in claim 1, wherein step (a) comprises placing a mesh on the erosion resistant material, subsequently depositing the vibration damping coating and removing the mesh to form the plurality of segments.

4. A method as claimed in claim 1, wherein step (a) comprises treating the vibration damping coating during or after deposition of the vibration damping coating to cause the vibration damping coating to form a plurality of segments.

5. A method as claimed in claim 1 wherein in step (a) the portion of erosion resistant material is flat during the deposition of the vibration damping coating and in step (b) the portion of erosion resistant material is molded to the shape of the article during the bonding of the portion of the erosion resistant material and the vibration damping coating to the surface of the article.

6. A method as claimed in claim 1 wherein after step (a) and before step (b) the vibration damping coating is impregnated with a polymer material.

7. A method as claimed in claim 1 wherein the vibration damping coating comprises magnesium aluminate, calcium silicate, zirconia or yttria stabilized zirconia.

8. A method as claimed in claim 1 wherein the erosion resistant material comprises a metal.

9. A method as claimed in claim 8 wherein the erosion resistant material comprises stainless steel, a nickel alloy or a cobalt alloy.

10. A method as claimed in claim 1 wherein an adhesive for adhesive bonding comprises a structural adhesive.

11. A method as claimed in claim 1 comprising heat treating the portion of erosion resistant material and vibration damping coating after step (a) and before step (b).

12. A method as claimed in claim 1 comprising applying an erosion resistant coating to a second surface of the portion of erosion resistant material either before or after step (a).

13. A method as claimed in claim 12 comprising applying the erosion resistant coating by plasma spraying.

14. A method as claimed in claim 1 wherein the article comprises a component of a gas turbine engine.

15. A method as claimed in claim 14 wherein the article comprises a fan blade, a compressor blade, a compressor vane, a turbine blade or a turbine vane.

16. A method as claimed in claim 14 wherein the article comprises a rotor with integral blades.

17. A method as claimed in claim 16 wherein the blades are diffusion bonded onto, friction welded onto or machined out of the rotor.

* * * * *